United States Patent [19]

Parks

[11] Patent Number: 4,781,379

[45] Date of Patent: Nov. 1, 1988

[54] DEVICE FOR STORING AND CHECKING WINNING NUMBERS ON LOTTO TICKETS

[76] Inventor: James H. Parks, 413 Agate Ct., Antioch, Calif. 94509

[21] Appl. No.: 88,565

[22] Filed: Aug. 24, 1987

[51] Int. Cl.[4] ..... A63F 3/06

[52] U.S. Cl. ..... 273/148 R; 150/147

[58] Field of Search ..... 273/148 R, 269; 434/354, 364; 283/1 A, 903; 150/145, 147

[56] References Cited

FOREIGN PATENT DOCUMENTS

| | | | |
|---|---|---|---|
| 2721968 | 11/1978 | Fed. Rep. of Germany | 273/148 R |
| 3002171 | 7/1981 | Fed. Rep. of Germany | 273/148 R |
| 3235783 | 3/1984 | Fed. Rep. of Germany | 273/148 R |
| 979795 | 12/1950 | France | 273/148 R |
| 2457114 | 5/1979 | France | 273/148 R |
| 2412326 | 8/1979 | France | 273/148 R |
| 2429028 | 2/1980 | France | 273/148 R |
| 2483243 | 12/1981 | France | 273/148 R |
| 2509187 | 1/1983 | France | 273/148 R |
| 2513529 | 4/1983 | France | 273/148 R |
| 2553291 | 4/1985 | France | 273/148 R |
| 2575077 | 6/1986 | France | 273/148 R |

*Primary Examiner*—Anton O. Oechsle

*Attorney, Agent, or Firm*—Schapp and Hatch

[57] ABSTRACT

A single fold wallet for storing lottery tickets, and for readily identifying winning numbers on each ticket, having flat sides provided with transparent faced pockets, a swingable flat member having a rectangular transparent window for overlying lotto tickets, and a marking pen carried in a loop of flexible material at the fold line of the wallet and formed for marking rings on the transparent window to indicate the location of winning numbers in each of the numbered unit areas of lotto tickets.

4 Claims, 1 Drawing Sheet

DEVICE FOR STORING AND CHECKING WINNING NUMBERS ON LOTTO TICKETS

BACKGROUND OF THE INVENTION

1. Field of the Invention

This invention relates to devices for checking winning combinations of numbers on lottery tickets printed with multiple numbered unit areas of similar size and arrangement and in which the lottery numbers are arranged in vertical and horizontal rows.

2. Description of the Prior Art

Various devices have been proposed for quickly checking marked lottery or lotto tickets for winning combinations of numbers once the numbers have been drawn. Among these are devices having a transparent sheet which can be placed in overlying relation to a group of numbers on a lotto ticket. The sheet is then marked to indicate the relative location of the numbers drawn in the lottery. The marked, transparent sheet is then placed over the lottery ticket so that the user can visually observe wherever marked numbers coincide with the drawn numbers. Examples of such devices are listed as follows:

| Patent No. | Country | Inventor |
|---|---|---|
| 4,607,845 | U.S.A. | William Gallo |
| 2429028 | France | Bienvenu |
| 2553291 | France | Bourel et al. |
| 2513529 | France | de Cagny |
| 2509187 | France | Saliu |
| 2483243 | France | Pomar |
| 2457114 | France | Zago |
| 979,795 | France | Laster |
| 27 21968 | Germany | Welker |
| 30 02 171 | Germany | Gehrmann |

While these devices are capable of identifying combinations of winning numbers marked on lottery tickets, they are cumbersome in use and it is difficult to align the marked number locations precisely with the marked numbers on the lotto tickets. Various expedients are used for holding the tickets in precise registry with the transparent, marked sheet, but it is time consuming and difficult to mount and dismount the lotto tickets in the desired positional relationship.

None of the above devices contemplate the problem of storing lotto tickets from the time they are purchased until the lotto drawing has been completed and the winning numbers checked.

The above-listed patents are believed to be relevant to the present invention because they show marking of a transparent sheet with the location of winning numbers and placing the transparent sheet over the lotto ticket so that winning numbers can be readily identified, and because they were adduced by a prior art search made by an independent searcher. A copy of each of the above-listed patents is supplied to the Patent and Trademark Office herewith.

The term "prior art" as used herein or in any statement made by or on behalf of the applicant means only that any document or thing referred to as prior art bears, directly or inferentially a date which is earlier than the effective date of this application.

No representation or admission is made that any of the above-listed documents is part of the prior art in any acceptation of that term, or that no more pertinent information exists.

SUMMARY OF THE INVENTION

The present invention provides a wallet-like device for storing lotto tickets and for readily identifying winning numbers on each ticket after the winning numbers have been drawn. The wallet is of the single fold type having pockets on the inner faces of its two sides in which marked lotto tickets can be safely stored until winning numbers are ascertained. Preferably, the storage pockets have transparent faces for easy visual inspection of the contents of the pocket.

An opaque sheet member is swingably secured to the wallet at the single fold and extends to overlie one of the sides when the wallet is unfolded to lie flat. A rectangular portion of the opaque sheet member is made of transparent material to provide a window sized to display a numbered unit area of a lotto ticket positioned underneath the opaque sheet member.

It should be noted that the lotto tickets with which the present device is to be used have printed upon them multiple "numbered unit areas", e.g., rectangular areas of similar size in which rows and columns of numbers are printed with the numbers in each of the number unit areas being in exactly the same position in such area as the corresponding numbers in other numbered unit areas. Thus, when a numbered unit area of a lotto ticket is registered with the transparent rectangular window portion, each of the numbers printed on the lotto ticket is always in the same position relative to the window.

To identify winning numbers on each ticket, the numbered unit area of one ticket has marked thereon the winning numbers drawn in the lotto drawing. The transparent rectangular area is registered with the numbered unit area and circles or rings are drawn on the rectangular transparent portion encircling each of the winning numbers. The rings are drawn with a suitable device such as a grease pencil or marking pen capable of leaving rings on the transparent window which can be readily identified, but which can be easily removed once the winning numbers have been identified on each of the numbered unit areas of each of the lotto tickets in the possession of the user. Preferably, the rings of indicator material are colored for rapid visual identification.

The marking device is mounted in the fold of the wallet in a loop of flexible material formed on the inner side of the wallet running along the single fold. Conveniently, this loop is provided by an extension of the opaque sheet member referred to above.

It is therefore a principal object of the present invention to provide a device capable of storing lotto tickets from the time purchased until the time that winning combinations of numbers on each ticket are identified.

Another object of the invention is to provide a device of the character described which is capable of readily identifying winning numbers on each numbered unit area of each lotto ticket.

A further object of the present invention is to provide a device of the character described which is compact, sturdy, economical, easy to use and occupies minimum space.

Other objects and features of advantage will become apparent as the specification progresses and from the claims.

Figures 1, 2, 3:
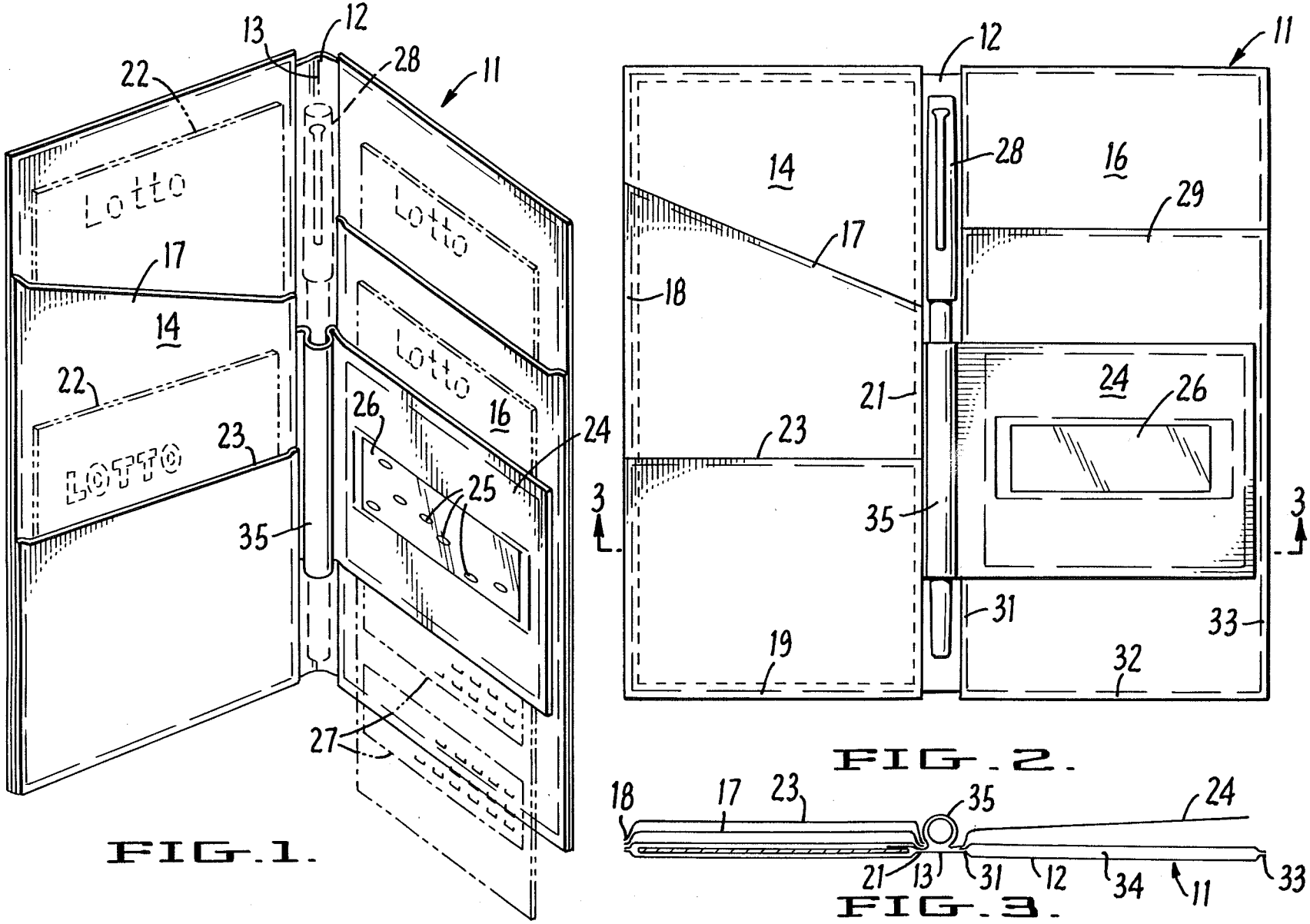
FIG. 1 is a perspective view of a device for storing lotto tickets and for readily identifying winning numbers on each ticket constructed in accordance with the present invention.
FIG. 2 is a plan view of the device of FIG. 1 opened out flat and lying on its back.
FIG. 3 is a vertical cross sectional view taken substantially on the plane of line 3—3 of FIG. 2.

While only the preferred form of the invention is illustrated in the drawings, it will be apparent that various modifications could be made without departing from the ambit of the claims.

DESCRIPTION OF THE PREFERRED EMBODIMENT

As may be seen in the accompanying drawings, the device of the present invention for storing lotto tickets and for readily identifying winning numbers on each ticket provides a singlefold wallet shaped body 11 formed from a rectangular, flexible backing member 12 capable of swinging open and closed around a central fold area 13 to afford flat sides 14 and 16 of approximately equal area. A transparent sheet member 17 covers a major portion of the side 14 of the wallet 11 and is secured to the backing member 12 around three of its sides 18, 19 and 21 to provide a transparent faced pocket adapted for storing a plurality of lotto tickets 22. If desired, more than one of the transparent faced pockets may be stacked on side 14 such as is shown at 23.

For accomplishing identification of winning numbers on each lotto ticket, an opaque sheet member 24 is secured to the wallet 11 at fold 13 and extends therefrom to swingably overlie wallet side 16 when the wallet 11 is unfolded to lie flat, as illustrated in FIGS. 2 and 3 of the drawings.

A rectangular portion 26 of sheet member 24 is made of transparent material to provide a rectangular window formed for selective registration with successive rectangular numbered unit areas of lotto tickets lying on wallet side 16 below member 24. The size and shape of the window 16 corresponds exactly with the numbered unit areas 27 of the lotto tickets 22.

A sample lotto ticket 22 has the winning numbers marked thereon on one of the numbered unit areas 27. This numbered unit area is registered with the window 16 and rings 25 of colored material are marked on window 16 surrounding each of the winning numbers. When a sample purchased lotto ticket, with the winning selection of numbers marked, is placed under member 24 with the marked numbered unit area 27 in registration with transparent window 26, the user utilizes a marking pen 28 to form the rings 25 in the appropriate locations encircling the winning numbers. Thereafter, successive marked purchased lotto cards are placed between member 24 and wallet side 16 and the number and identity of winning number combinations is easily ascertained because any winning numbers will be encircled by the rings 25.

To provide further storage capacity a second transparent sheet member 29 is mounted in covering relation to a major portion of the wallet side 16 and is secured thereto around three of its sides 31, 32 and 33 to provide a second pocket 34 adapted for storing a plurality of lottery tickets.

Preferably, and as shown, a loop 35 of flexible material is mounted along fold line 13 to accomodate removable insertion of the marking pen 28. Preferably, this loop 35 is provided by an extension of the opaque sheet member 24.

From the foregoing, it will be apparent that the device for storing lotto tickets and for readily identifying winning numbers on each ticket of the resent invention represents a novel and valuable contribution to the art of handling lottery tickets from purchase to identification of winning tickets.

What is claimed is:

1. A device for storing lotto tickets and for readily identifying winning numbers on each ticket, comprising a single fold flexible wallet of opaque material having flat sides of approximately equal area and a central fold line between said sides, a transparent sheet member covering a major portion of one of said sides of said wallet and secured thereto around three of its sides to provide a transparent faced pocket adapted for storing a plurality of lottery tickets, an opaque sheet member secured to said wallet at the single fold thereof and extending therefrom to overlie the other of said sides when said wallet is unfolded to lie flat, a rectangular portion of said last named sheet member of commensurate size with a numbered unit area of a lotto ticket being transparent and formed for selective registration with successive rectangular numbered unit areas of lotto tickets, said transparent rectangular portion being formed for removably receiving rings of colored indicator material at locations coinciding with the chosen numbers on a single unit area of said lotto ticket.

2. A device for storing lotto tickets and for readily identifying winning numbers on each ticket, as described in claim 1, and wherein a second transparent sheet member is mounted in covering relation to a major portion of said other of said sides of said wallet and is secured thereto around three of its sides to provide a second pocket adapted for storing a plurality of lottery tickets.

3. A device for storing lotto tickets and for readily identifying winning numbers on each ticket, as described in claim 1, and wherein a loop of flexible material is formed on the inner side of said wallet running along said single fold for removably supporting an elongated pen providing said colored indicator material.

4. A device for storing lotto tickets and for readily identifying winning numbers on each ticket, as described in claim 3, and wherein said loop of flexible material is provided by an extension of said opaque sheet member.

* * * * *